US008723734B2

(12) United States Patent
Chung et al.

(10) Patent No.: US 8,723,734 B2
(45) Date of Patent: May 13, 2014

(54) MIMO ANTENNA APPARATUS

(75) Inventors: Jae Young Chung, Seoul (KR); Dong-Jin Kim, Seoul (KR); Tae Sik Yang, Gyeonggi-do (KR); Joong Ho Jeong, Seoul (KR); Ju Hyung Lee, Gyeonggi-do (KR)

(73) Assignee: Samsung Electronics Co., Ltd (KR)

( * ) Notice: Subject to any disclaimer, the term of this patent is extended or adjusted under 35 U.S.C. 154(b) by 427 days.

(21) Appl. No.: 13/283,029

(22) Filed: Oct. 27, 2011

(65) Prior Publication Data

US 2012/0105296 A1 May 3, 2012

(30) Foreign Application Priority Data

Oct. 27, 2010 (KR) ..... 10-2010-0105144

(51) Int. Cl.
*H01Q 1/38* (2006.01)

(52) U.S. Cl.
USPC ..... 343/700 MS; 343/702; 343/895

(58) Field of Classification Search
USPC ..... 343/700 MS, 702, 848, 895
See application file for complete search history.

(56) References Cited

U.S. PATENT DOCUMENTS

| | | | | |
|---|---|---|---|---|
| 6,950,072 | B2 * | 9/2005 | Miyata et al. | 343/702 |
| 7,061,434 | B2 * | 6/2006 | Aoyama et al. | 343/702 |
| 2004/0169606 | A1 * | 9/2004 | Sato et al. | 343/702 |
| 2013/0120198 | A1 * | 5/2013 | Maeda et al. | 343/700 MS |
| 2013/0335289 | A1 * | 12/2013 | Hara et al. | 343/848 |

* cited by examiner

*Primary Examiner* — Tan Ho
(74) *Attorney, Agent, or Firm* — The Farrell Law Firm, P.C.

(57) ABSTRACT

A Multiple Input Multiple Output (MIMO) antenna apparatus is provided. The apparatus includes antenna devices that operate in respective resonant frequency bands. The apparatus also includes a main board comprising a device region and a ground region. The antenna devices are disposed on the device region. The ground plate is disposed on the ground region for grounding the antenna devices. The apparatus also includes at least one isolation device having a negatively charged line that protrudes from the ground plate and extends between the antenna devices on the device region, and a positively charged line that extends around the negatively charged line and connects the antenna devices to each other. The isolation device induces an electromagnetic wave that is generated by the antenna devices between the negative and positively charged lines to isolate the antenna devices from each other.

14 Claims, 18 Drawing Sheets

<a>

<b>

MIMO ANTENNA APPARATUS

PRIORITY

This application claims priority under 35 U.S.C. §119(a) to an application filed in the Korean Intellectual Property Office on Oct. 27, 2010, and assigned Serial No. 10-2010-0105144, the contents of which are incorporated herein by reference.

BACKGROUND OF THE INVENTION

1. Field of the Invention

The present invention relates generally to an antenna apparatus and, more particularly, to a Multiple-Input Multiple-Output (MIMO) antenna apparatus having a plurality of antenna devices.

2. Description of the Related Art

Wireless communication systems support various multimedia services, such as, for example, video, audio, and gaming services. In order to ensure that multimedia services provided in the wireless communication system are stable, a high data rate must be guaranteed for a large amount of multimedia data. Accordingly, attempts have been made to improve the performance of the antenna apparatus of a communication terminal. The antenna apparatus plays a significant role in that it transmits and receives signals carrying the multimedia service data. Recent wireless communication systems include a mobile terminal that is equipped with a MIMO antenna apparatus to improve transmission/reception efficiency. The MIMO antenna apparatus includes an array of antenna devices. Through the multiple antenna devices, the MIMO antenna apparatus can transmit and receive radio signals at a high data rate on a predetermined frequency band.

With the MIMO antenna apparatus, the data transfer rate is higher as electromagnetic coupling among the antenna devices is lower. The amount of coupling is quantified by the term "antenna correlation" or "envelope correlation. For MIMO antenna apparatus in small handsets, the correlation is relatively high as the antenna devices are closely packed in a limited space.

SUMMARY OF THE INVENTION

The present invention has been made to address at least the above problems and/or disadvantages and to provide at least the advantages described below. Accordingly, an aspect of the present invention provides a MIMO antenna apparatus that is capable of reducing a correlation value as a factor indicating electromagnetic coupling among the antenna devices.

According to one aspect of the present invention, a MIMO antenna apparatus is provided. The apparatus includes a plurality of antenna devices that operate in respective resonant frequency bands when power is supplied. The apparatus also includes a main board comprising a device region and a ground region. The plurality of antenna devices are disposed on the device region. A ground plate is disposed on the ground region for grounding the plurality of antenna devices. The apparatus also includes at least one isolation device having a negatively charged line that protrudes from the ground plate and extends between the plurality of antenna devices on the device region, and a positively charged line that extends around the negatively charged line and connects the plurality of antenna devices to each other. The isolation device induces an electromagnetic wave that is generated by the plurality of antenna devices between the negative and positively charged lines to isolate the plurality of antenna devices from each other.

According to another aspect of the present invention, an isolation device is provided. The device includes a negatively charged line that protrudes from a ground plate and extends between a plurality of antenna devices. The device also includes a positively charged line that extends around the negatively charged line and connects the plurality of antenna devices to each other. The isolation device induces an electromagnetic wave that is generated by the plurality of antenna devices between the negative and positively charged lines to isolate the plurality of antenna devices from each other.

DETAILED DESCRIPTION OF EMBODIMENTS OF THE PRESENT INVENTION

Figure 1:
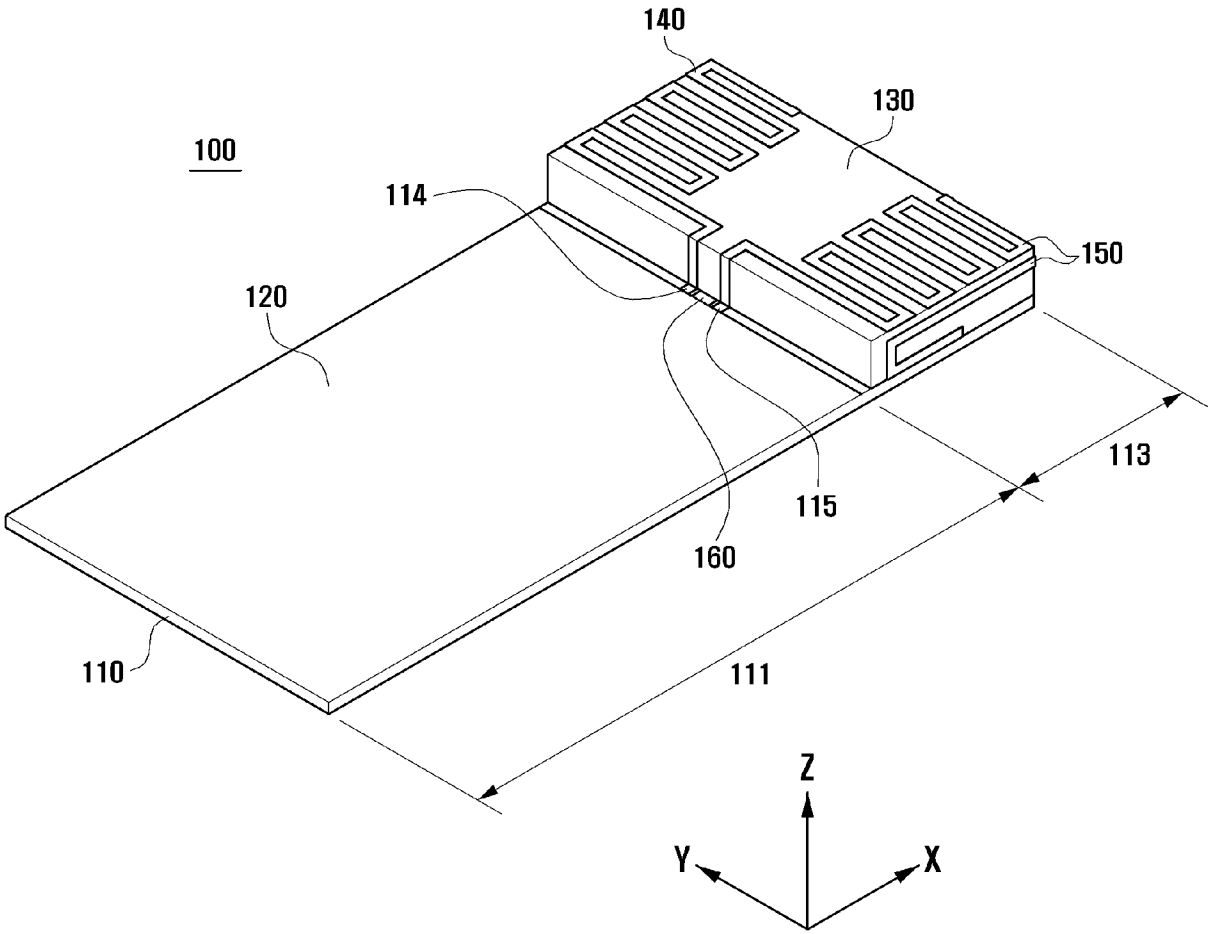
FIG. 1 is a diagram illustrating a perspective view of a MIMO antenna apparatus, according to an embodiment of the present invention.

Embodiments of the present invention are described in detail with reference to the accompanying drawings. The same or similar components may be designated by the same or similar reference numerals although they are illustrated in different drawings. Detailed descriptions of constructions or processes known in the art may be omitted to avoid obscuring the subject matter of the present invention.

Figure 2:
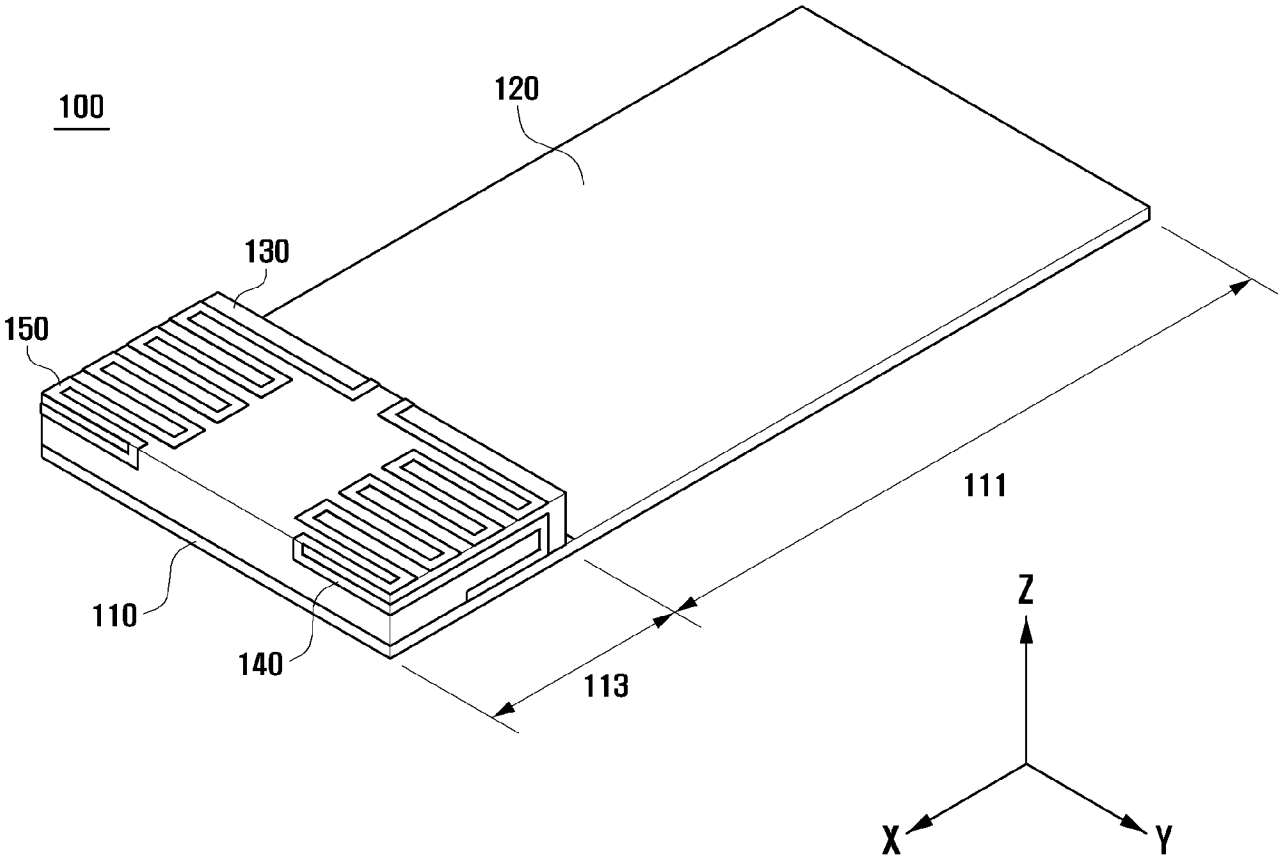
FIG. 2 is a diagram illustrating another perspective view of the MIMO antenna apparatus of FIG. 1, according to an embodiment of the present invention.
Figure 3:
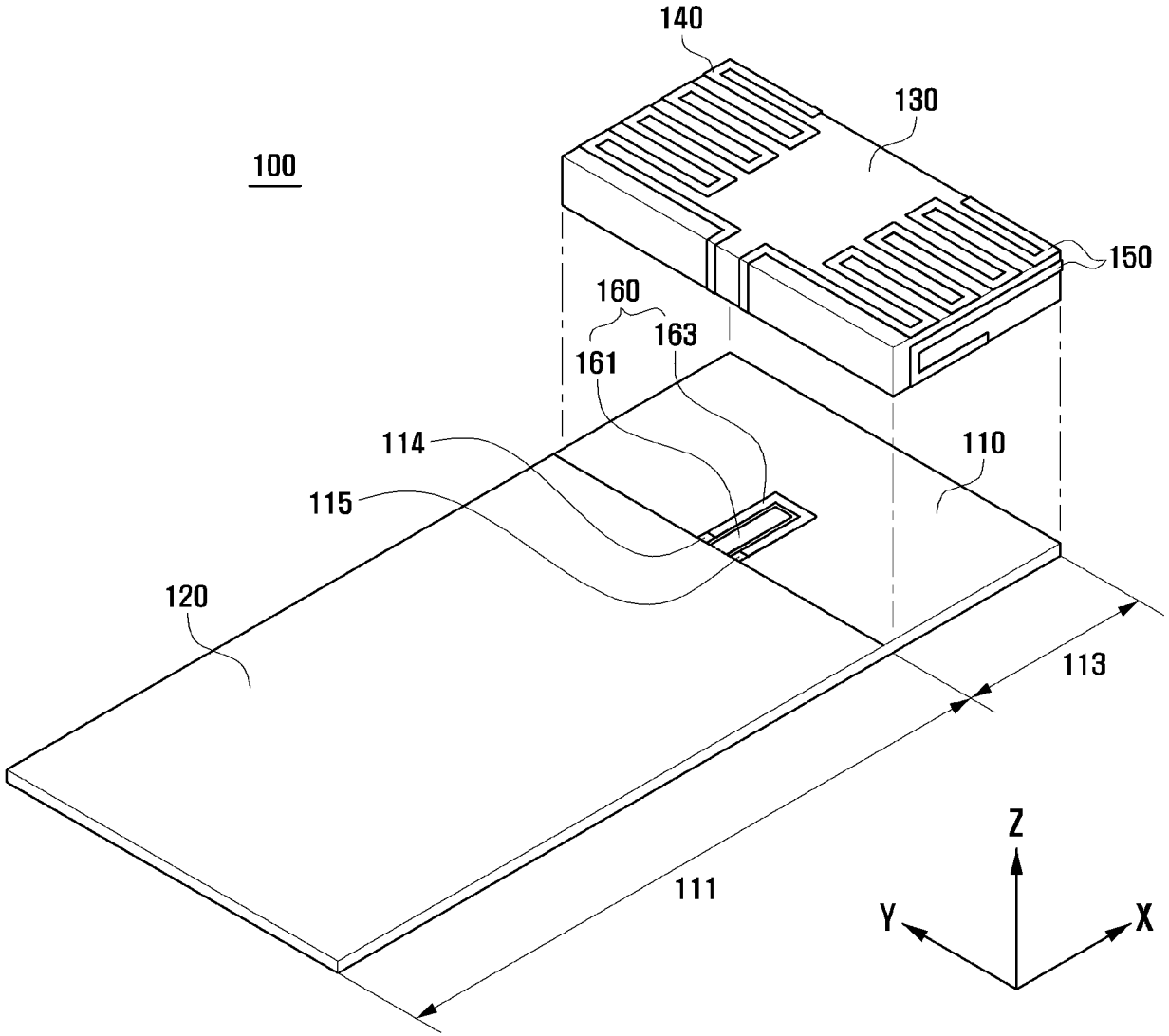
FIG. 3 is a diagram illustrating a dissembled perspective view of the MIMO antenna apparatus of FIG. 1, according to an embodiment of the present invention.

FIG. 1 is a diagram illustrating a perspective view of a MIMO antenna apparatus, according to an embodiment of the present invention. FIG. 2 is a diagram illustrating another perspective view of the MIMO antenna apparatus of FIG. 1, according to an embodiment of the present invention. FIG. 3 is a diagram illustrating a dissembled perspective view of the MIMO antenna apparatus of FIG. 1, according to an embodiment of the present invention. In the following, the description is directed to an embodiment in which the MIMO antenna apparatus is implemented with a Printed Circuit Board (PCB).

Referring to FIGS. 1 to 3, a MIMO antenna apparatus 100 includes a main board 110, a ground plate 120, an antenna carrier 130, antenna devices 140 and 150, and an isolation device 160.

The main board 110 supports the MIMO antenna apparatus and supplies power. The main board 110 can be implemented in the form of a flat plate. A surface of the main board 110 is divided into a ground region 111 and a device region 113 in direction z. The main board 110 is also provided with a plurality of antenna ports 114 and 115. The antenna ports 114 and 115 are arranged on the device region 113. In addition, the main board 110 is made of a dielectric material having a plurality power supply lines. The main board 110 can be implemented as a plurality of laminated dielectric plates in a specific embodiment of the present invention.

The power supply lines are exposed at their both ends. Each of the power supply lines is connected to an external power source at one end. The power supply line is exposed at the other end outside by means of the device region 113, and is connected to the antenna ports 114 and 115. In this embodiment of the present invention, the external power source supplies power to the antenna powers 114 and 115 via the power supply lines. The power can be supplied through at least one of the power supply lines selectively.

The ground plate 120 is responsible for grounding the MIMO antenna apparatus 100. The ground plate 120 is arranged on the ground region 111 of the main board 110. Here, the ground plate 120 is formed as a flat plate. The ground plate 120 can be arranged in parallel with one surface of the main board 110, e.g., in directions of X and Y axes, to cover the entire surface of the ground region 111. The ground plate 120 also can be arranged perpendicular to one surface of the main board 110, e.g., in the direction of the Z axis, at an area of the ground region 111. In an embodiment of the present invention, the ground plate 120 can be implemented in the form of a flat plate having various shapes of grooves and holes.

The antenna carrier 130 is provided so as to act as a medium in the MIMO antenna apparatus 100. The antenna carrier 130 is mounted on the device region 113 of the main board 110. The antenna carrier 130 is implemented in the form of a flat plate having a predetermined thickness in the Z direction and a predetermined size defined in the X and Y directions. The antenna carrier 130 is implemented in a form corresponding to the device region 113 so as to protrude from the device region 113. The antenna carrier 130 is formed so as to expose the antenna ports 114 and 115 to the device region 113. The antenna carrier 130 is made of a dielectric material. The antenna carrier 130 can be implemented with characteristics that are identical to or different from those of the main board 110.

The antenna devices 140 and 150 are responsible for signal transmission and reception for the MIMO antenna apparatus. Specifically, at least one of the antenna devices 140 and 150 is resonant to at least one of the resonant frequency bands to transmit/receive an electromagnetic wave. The antenna devices 140 and 150 are arranged having a predetermined distance between each other on the device region 113 of the main board 110. The antenna devices 140 and 150 are implemented in the form of power supply lines made of a metallic material.

The antenna devices 140 and 150 are patterned so as to be extended along a surface of the antenna carrier 130. Specifically, the antenna devices 140 and 150 are arranged at a predetermined distance from the main board 110 and the ground plate 120, and are formed to be as long as a thickness or size of the antenna carrier 130.

The antenna devices 140 and 150 are electrically connected to the antenna ports 114 and 115, respectively. The power supply points are formed at the contact points between the antenna devices 140 and 150 and the antenna ports 114 and 115, i.e., at the ends of the antenna devices 140 and 150. The antenna devices 140 and 150 are also grounded by means of the ground plate 120. The antenna devices 140 and 150 can contact the ground plate at their other ends. Each of the antenna devices 140 and 150 can be formed to have at least one curved portion. Specifically, each of the antenna devices 140 and 150 is formed with a meandering shape.

According to an embodiment of the present invention, if power is supplied from the external power source to the antenna ports 114 and 115, the antenna devices 140 and 150 are resonant in the resonant frequency band. The power can be selectively supplied to at least one of the antenna ports 114 and 115, such that the corresponding antenna devices 140 and 150 are resonant in the resonant frequency band. During operation, the antenna devices 140 and 150 establish magnetic fields so as to generate electromagnetic coupling between antenna devices 140 and 150. Specifically, the correlation between antenna devices 140 and 150 may increase to a relatively high level.

The isolation device 160 is responsible for controlling interference between the antenna devices 140 and 150 of the MIMO antenna apparatus 100. Specifically, the isolation device 160 cancels electromagnetic field coupling from one antenna to the other so as to isolate the antenna devices 140 and 150 from each other. The isolation device 160 is arranged between the antenna devices 140 and 150 in the device region 113 of the main board 110. Specifically, the isolation device 160 can be mounted on the surface of the main board 110 in the device region 113. The isolation device 160 can be formed such that the antenna devices 140 and 150 are arranged with a distance corresponding to the thickness and size of the antenna carrier 130. The isolation device 160 is provided with a negatively charged line 161 and a positively charged line 163.

The negatively charged line 161 extends from the ground plate 120 so as to protrude between the antenna devices 140 and 150. Specifically, the negatively charged line 161 has the same characteristics as the ground plate 120. The negatively charged line 161 is shaped in the form of a bar. The negatively charged line 161 can be arranged so as to be equally distant from the respective antenna devices 140 and 150.

The positively charged line 163 is connected to the antenna devices 140 and 150. Specifically, the positively charged line 163 is electrically connected to the antenna ports 114 and 115, and can be extended from the antenna ports 114 and 115. The positively charged line 163 is extended in parallel with the negatively charged line 161 to maintain a predetermined distance. The positively charged line 163 is implemented as a power supply line made of a metallic material. The positively charged line 163 is shaped to have at least one curved portion. Here, the positively charged line 163 can be implemented in a looped shape.

According to an embodiment of the present invention, when the antenna devices 140 and 150 operate, an electromagnetic wave is induced at the isolation device 160. When the power is supplied from the external power source to the antenna ports 114 and 115, the positively charged line 163 operates as a positive electrode, and the negatively charged line 161 operates as a negative electrode. The electromagnetic wave is induced along the space between the negatively charged line 161 and the positively charged line 163. While the MIMO antenna apparatus 100 is operating, the power is supplied to the antenna devices 140 and 150 and the isolation device 160 simultaneously. The antenna devices 140 and 150 and the positively charged line 163 share the ground plate 120 and the negatively charged line 161 to be grounded simultaneously. The antenna devices 140 and 150 operate with a relatively high loss, while the isolation device 160 operates with a relatively low loss, e.g., a loss rate of approximate 0. Thus, the MIMO antenna apparatus 100 operates with a large difference between loss rates of internal components, and thus, a relatively high dispersion. This leads to out-of-phase cancellation of the electromagnetic wave induced along the isolation device 160 and the electromagnetic wave coupled between the antenna devices 140 and 150. Such out-of-phase cancellation is represented by the negative group delay phenomenon in the S21 measurement of the MIMO antenna apparatus. As a consequence, the correlation between the antenna devices 140 and 150 of the MIMO antenna apparatus 100 is minimized. Accordingly, the antenna devices 140 and 150 of the MIMO antenna apparatus 100 are isolated from each other. In order for the antenna devices 140 and 150 and the isolation device 160 to perform in the manner described above, these devices are designed to have different inductances and capacitances, according to an embodiment of the present invention.

Figure 4:
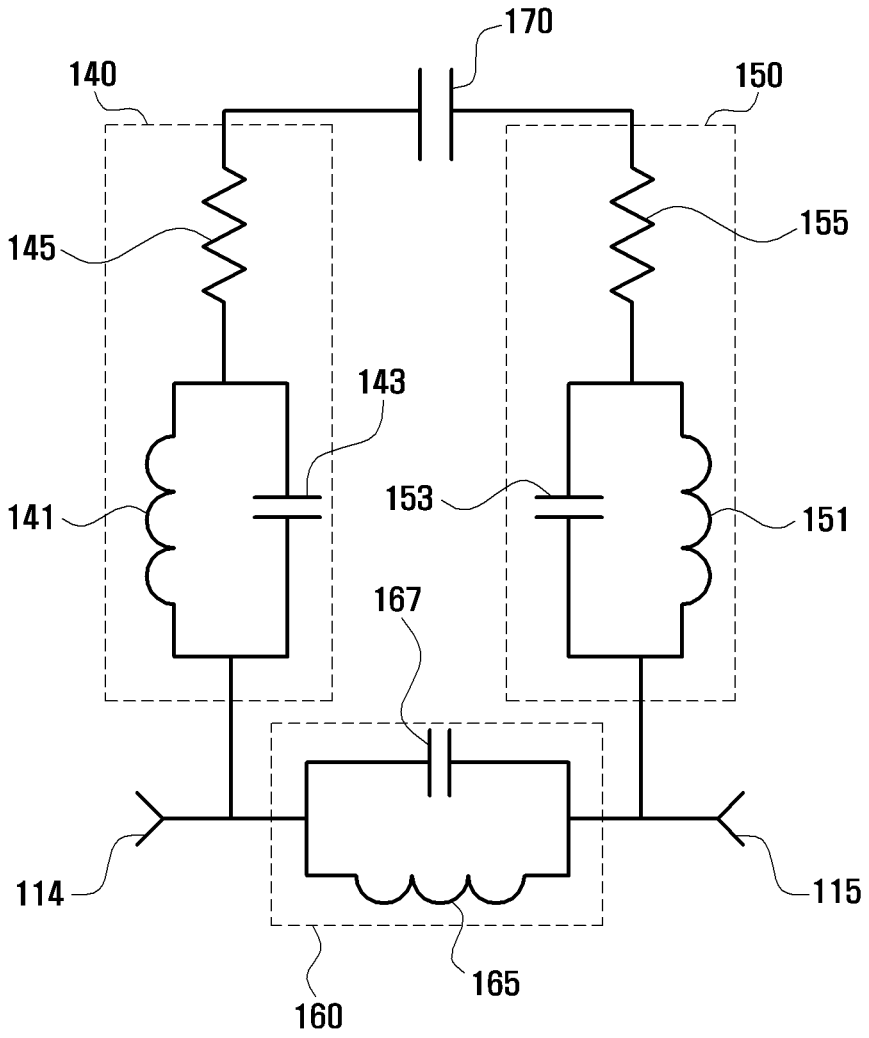
FIG. 4 is a circuit diagram illustrating an equivalent circuit of the MIMO antenna apparatus, according to an embodiment of the present invention.

FIG. 4 is a circuit diagram illustrating an equivalent circuit of the MIMO antenna apparatus, according to an embodiment of the present invention. Although this embodiment of the present invention is directed to the case where the antenna devices and the isolation devices are implemented as single cell, the embodiments of the present invention are not limited thereto. For example, the antenna devices and isolation device can also be implemented as a combination of a plurality of cells.

Referring to FIG. 4, the MIMO antenna apparatus 100 includes the antenna devices 140 and 150 connected to the isolation device 160. The electrical connection between the antenna devices 140 and 150 can be expressed as combined capacitance and is represented by a combined capacitor 170 in FIG. 4.

Each of the antenna devices 140 and 150 is configured to have operative inductance, operative capacitance, and operative resistance so as to be resonant in at least one resonance frequency band. The antenna devices 140 and 150 include respective device inductors 141 and 151, respective device capacitors 143 and 153, and respective device resistors 145 and 155. Each of the antenna devices 140 and 150 includes a pair of device inductor and capacitor connected in parallel, and the pairs are connected in series. In each of the antenna devices 140 and 150, the device resister is connected to the pair of the parallel device inductor and device capacitor in series.

The device has electric characteristics that are equal to the equivalent circuit according to the configuration, shape, and material of the antenna devices 140 and 150. Each of the antenna devices 140 and 150 includes horizontal component lines extending parallel to the ground plate 120, i.e., in the Y axis direction, and the vertical component lines extending perpendicular to the ground plate 120, i.e. in the X axis direction. Specifically, the operative inductances of the device inductor 141 and 151 of the antenna devices 140 and 150 are determined according to the total lengths and widths of the horizontal component lines and the vertical component lines. Also, the operative capacitances of the device capacitors 143 and 153 of the antenna devices 140 and 150 are determined according to the distance between the horizontal component lines and ground plate 120 or the negatively charged line 161 and the length of the vertical component lines. The operative resistances of the device resistors 145 and 155 are determined according to the radiation loss and material loss of the antenna devices 140 and 150, i.e., the loss caused by the dielectric material of the antenna carrier 130 and metallic material of the antenna devices 140 and 150

The isolation device 160 is configured to have a cancellation inductance and a cancellation capacitance to induce out-of-phase cancellation at the resonant frequency. The isolation device 160 includes a cancellation inductor 165 and a cancellation capacitor 167. The cancellation inductor 165 and the cancellation capacitor 167 establish the connection between the antenna devices 140 and 150. The cancellation inductor 165 and the cancellation capacitor 167 establish the connection between the antenna ports 114 and 115. Also, the cancellation inductor 165 and the cancellaiton capacitor 167 are connected in series to the respective antenna ports 114 and 115 and in parallel to each other.

Here, the isolation device 160 shows the electrical characteristics of the equivalent circuit according to its structure and shape. Specifically, the cancellation inductance of the cancellation inductor 161 of the isolation device 160 is determined according to the size of the positively charged line 163, i.e., the total length and width of the positively charged line 163. The positively charged line 163 includes the horizontal component lines extending in parallel to the ground plate 120, i.e., in the Y axis direction, and the vertical component lines extending perpendicular to the ground plate 120, i.e., in the X axis direction. The cancellation capacitance of the block parallel capacitor 165 of the isolation device 160 is determined according to the distance between the positively charged line 163 and the ground plate 120 or the negatively charged line 161.

In above-described structure of an embodiment of the present invention, the MIMO antenna apparatus 100 has improved operative characteristics. A detailed description of the improvement of the operative characteristics of the above-described structure of the MIMO antenna apparatus is provided below with reference to FIGS. 5 to 9B.

Figure 5:
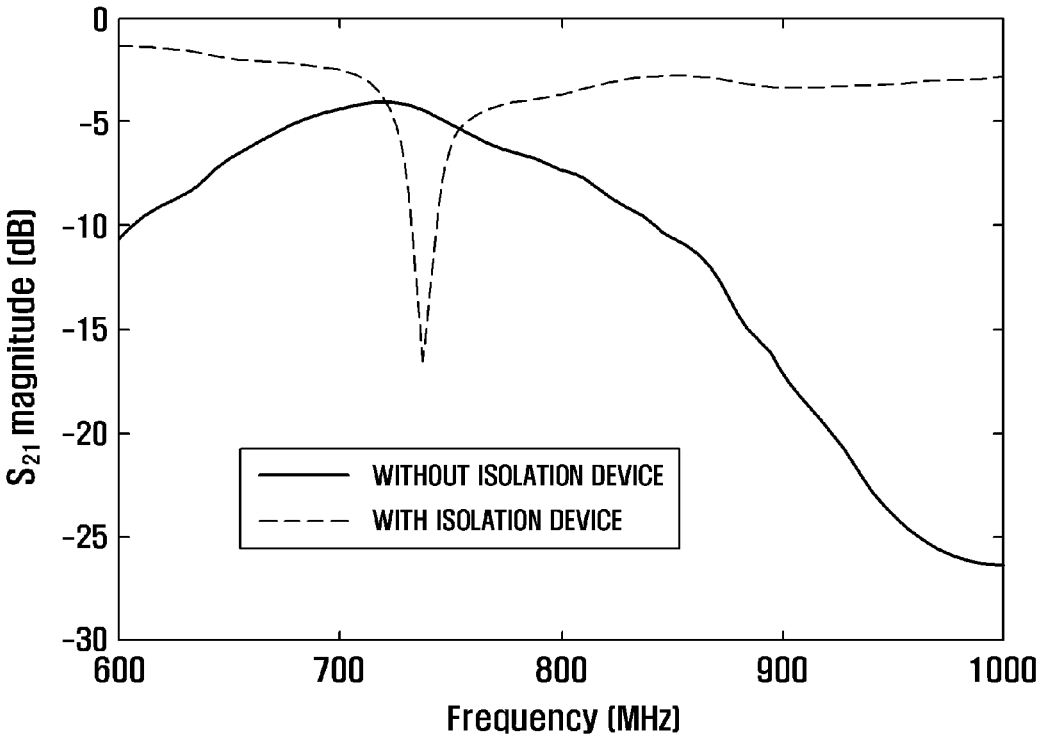
FIG. 5 is a graph illustrating $S_{21}$ magnitude of the MIMO antenna apparatus, according to an embodiment of the present invention.
Figure 6:
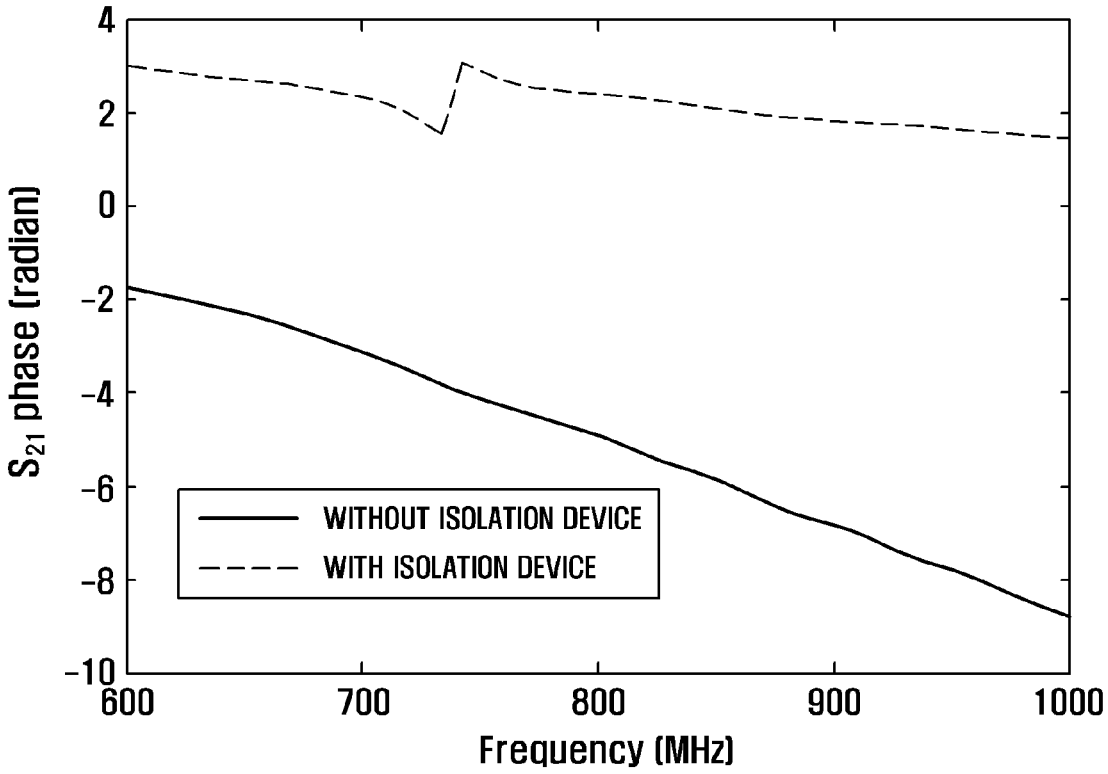
FIG. 6 is a graph illustrating $S_{21}$ phase of the MIMO antenna apparatus, according to an embodiment of the present invention.
Figure 7:
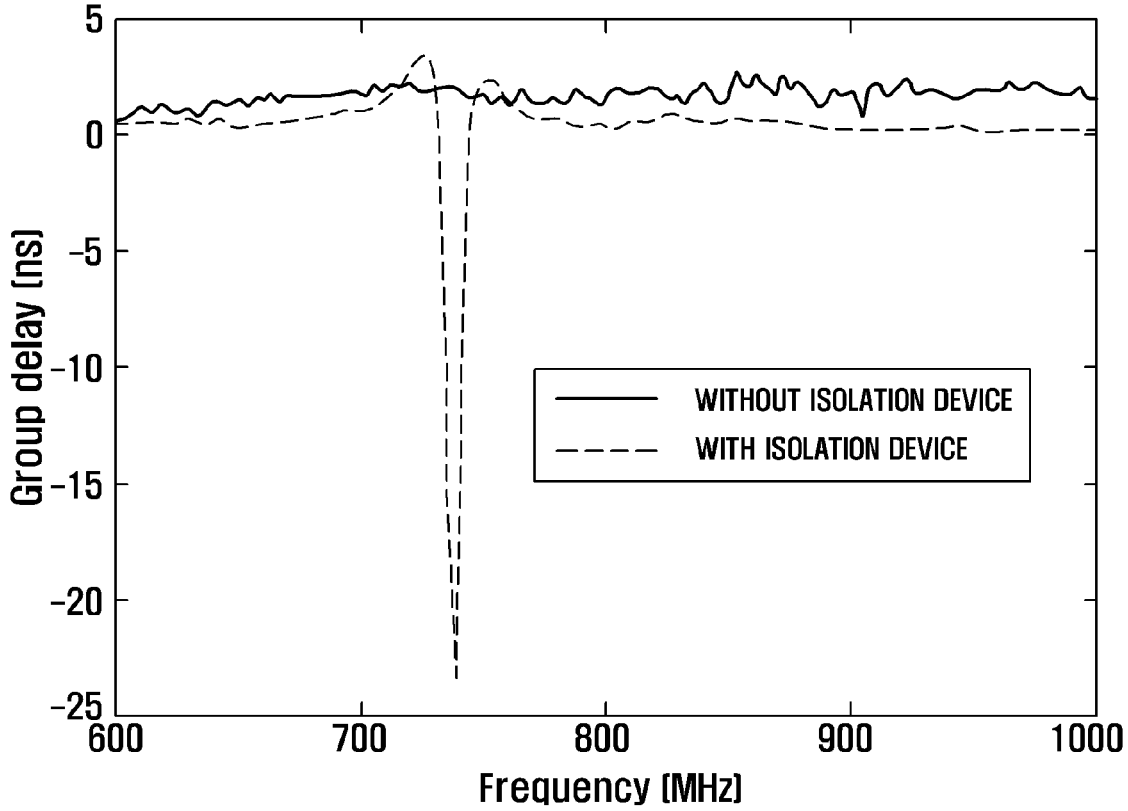
FIG. 7 is a graph illustrating group delay of the MIMO antenna apparatus, according to an embodiment of the present invention.
Figure 8:
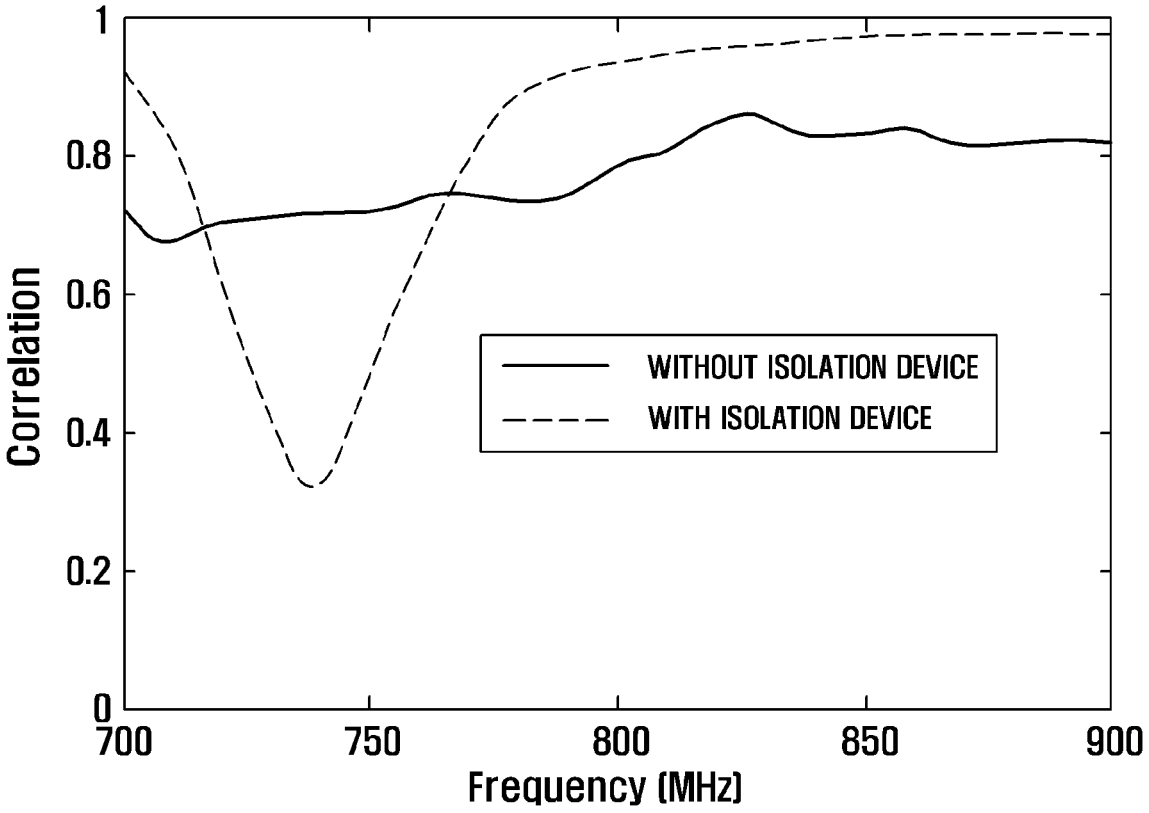
FIG. 8 is a graph illustrating correlation between antenna devices of the MIMO antenna apparatus, according to an embodiment of the present invention.
Figure 9B:
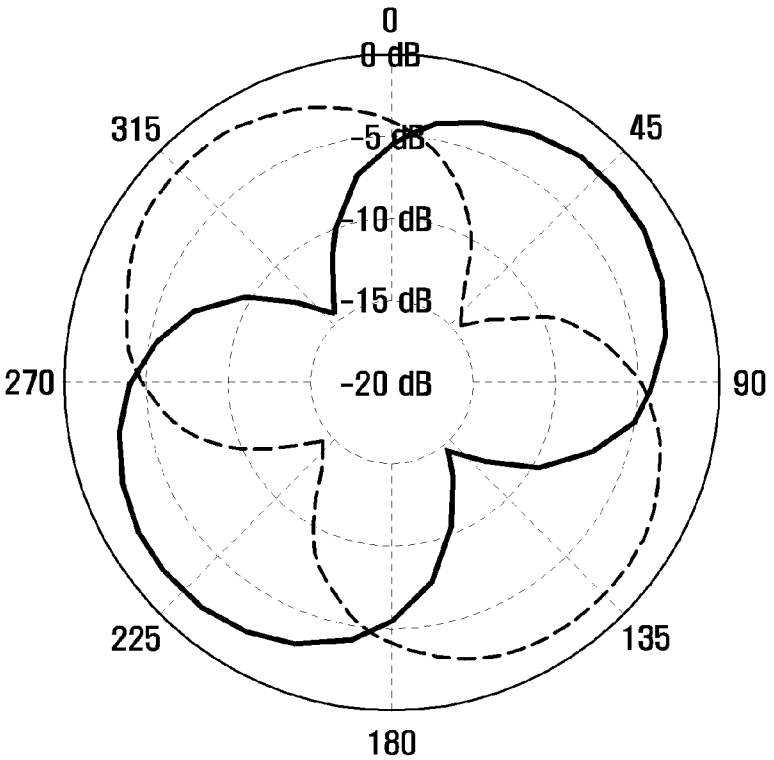
FIGS. 9A and 9B are graphs illustrating a polarization characteristic of the MIMO antenna apparatus, according to an embodiment of the present invention.

FIGS. 5 to 9B are graphs illustrating the operative characteristics of the MIMO antenna apparatus, according to an embodiment of the present invention. FIG. 5 is a graph illustrating $S_{21}$ magnitude of the MIMO antenna apparatus, according to an embodiment of the present invention. FIG. 6 is a graph illustrating $S_{21}$ phase of the MIMO antenna apparatus, according to an embodiment of the present invention. FIG. 7 is a graph illustrating group delay of the MIMO antenna apparatus, according to an embodiment of the present invention. FIG. 8 is a graph illustrating correlation between antenna devices of the MIMO antenna apparatus, according to an embodiment of the present invention. FIGS. 9A and 9B are graphs illustrating a polarization characteristic of the MIMO antenna apparatus, according to an embodiment of the present invention. FIGS. 5 to 9B show variations of operative characteristics of the MIMO antenna apparatus with and without isolation device. The description is directed to an embodiment of the present invention in which the resonant frequency band of the MIMO antenna is 740 MHz.

According to this embodiment of the present invention, the MIMO antenna apparatus is capable of reducing the S21 magnitude in the resonant frequency band by means of the isolation device, as shown in FIG. 5. The MIMO antenna apparatus is capable of inverting the $S_{21}$ phase gradient as shown in FIG. 6. FIGS. 5 and 6 are the graphs showing the dispersive characteristic of the S21 along to the frequency band. The $S_{21}$ magnitude denotes the amount of the interference between the antenna devices, and the $S_{21}$ phase denotes the phase of the interference between the antenna devices. The overturn at the resonant frequency in FIG. 6 indicates the negative group delay phenomenon at that frequency as shown in FIG. 7. The negative group delay is caused by out-of-phase cancellation and is accompanied by strong attenuation in S21 as shown in FIG. 5.

The strong attenuation in S21 at the resonant frequency band leads to the reduction of the correlation, as shown in FIG. 8. When the MIMO antenna apparatus is implemented without the isolation device, the correlation between the antenna devices is 0.7 in the resonant frequency band. Otherwise, when the isolation device is implemented in the MIMO antenna apparatus, the correlation reduces to 0.35. This means that the MIMO antenna apparatus is capable of improving the correlation reduction efficiency as much as 37% by using the isolation device.

Figure 9A:
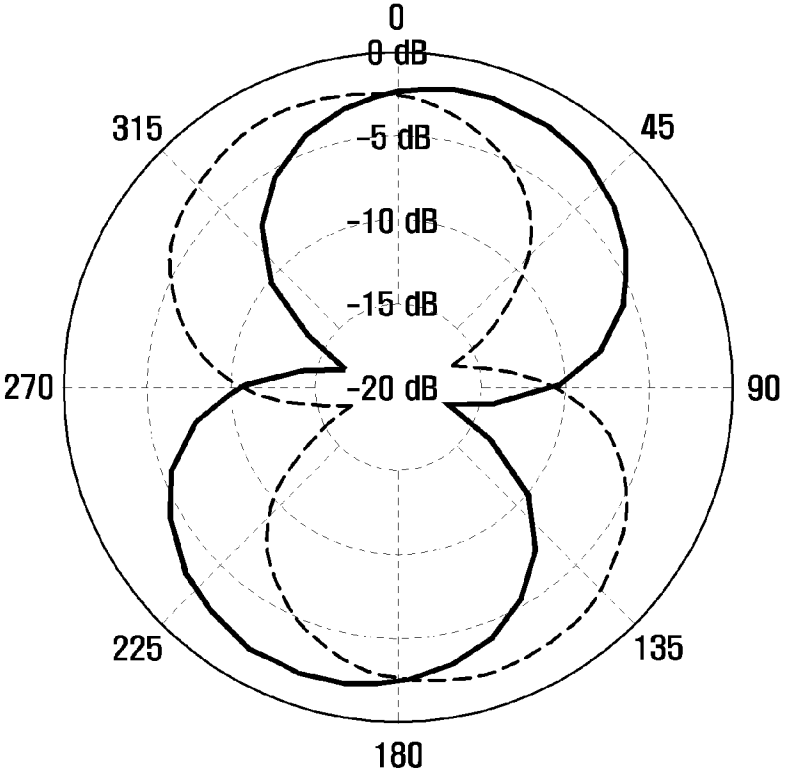

The reduction of the correlation between the antenna devices can be interpreted as the difference between radiation characteristics of the antenna devices. The MIMO antenna apparatus differentiates the polarization characteristics of the antenna devices by using the isolation device as shown in FIGS. 9A and 9B. The polarization characteristics are one of the radiation characteristics of the antenna devices. The larger the difference in the polarization characteristics antenna devices, the smaller the correlation. The polarization characteristics of the antenna devices of the MIMO antenna apparatus, with and without the isolation devices, are depicted using dotted and solid lines, respectively. Without the isolation device, the MIMO antenna apparatus has the per-element polarization characteristics shown in FIG. 9A. With the isolation device, the MIMO antenna apparatus has the per-element polarization characteristics shown in FIG. 9B, i.e., approximately orthogonal. Specifically, the isolation device differentiates the polarization characteristics of the individual antenna devices of the MIMO antenna apparatus, resulting in reduction of correlation between the antenna devices.

In the MIMO antenna apparatus of this embodiment of the present invention, the negative group delay phenomenon is induced according to at least two parameters. The parameters for inducing the group delay of voice include the total length of the antenna devices ($l_A$) and the total length ($l_0=2h_0+w_0$) of the horizontal component lines ($w_0$) and vertical component lines ($h_0$) of the positively charged line. The operative characteristics of the MIMO antenna apparatus can be adjusted by changing the parameters by tuning the MIMO antenna apparatus.

Figure 10:
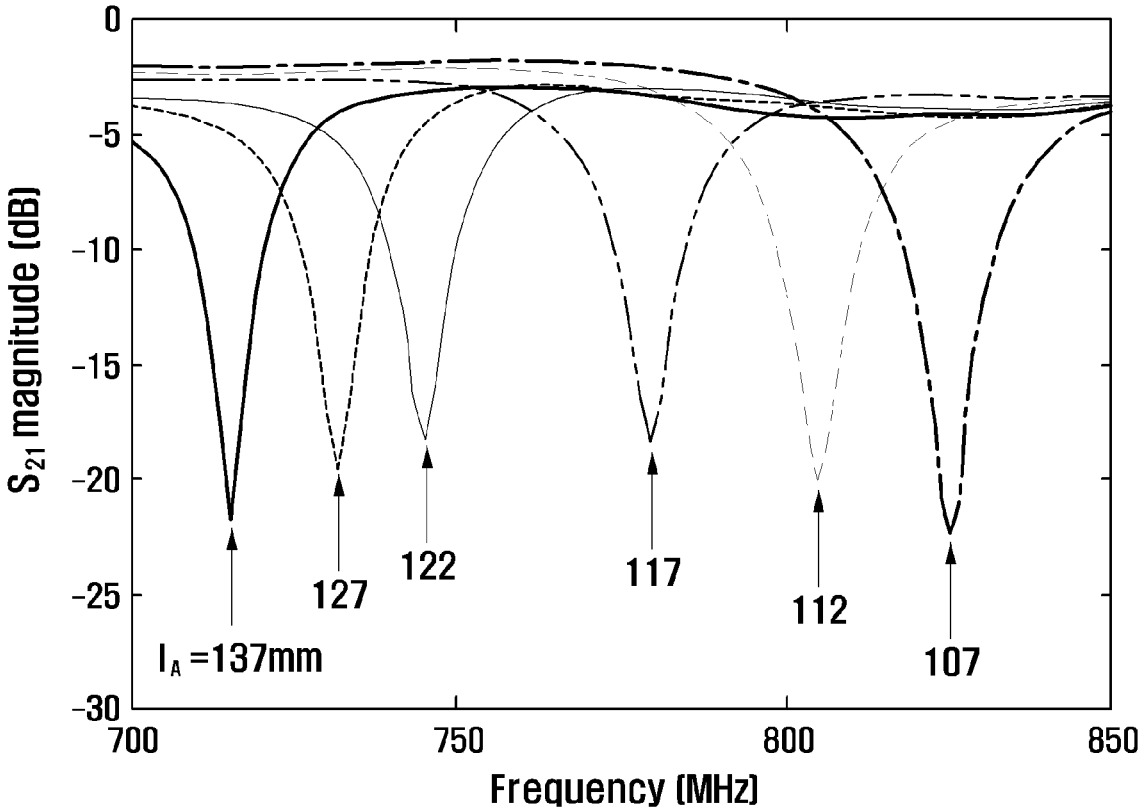
FIG. 10 is a graph illustrating variation of the $S_{21}$ magnitude in the MIMO antenna apparatus, according to an embodiment of the present invention.
Figure 11:
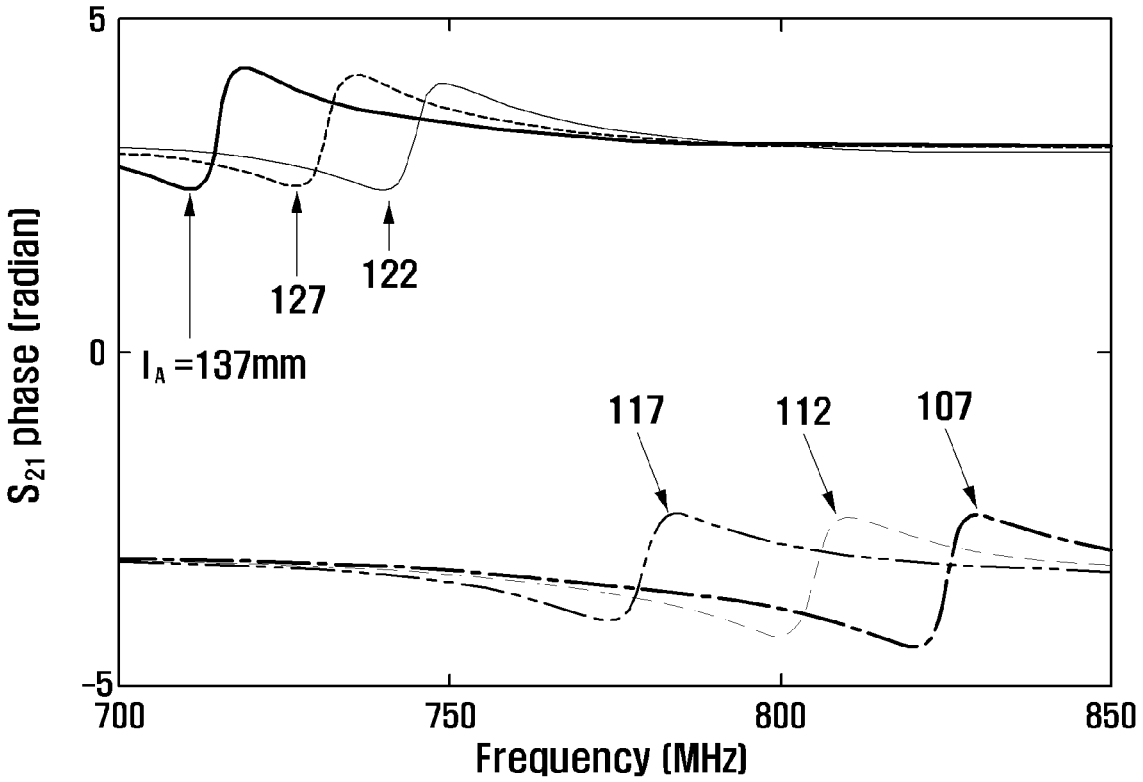
FIG. 11 is a graph illustrating variation of the $S_{21}$ phase in the MIMO antenna apparatus, according to an embodiment of the present invention.
Figure 12:
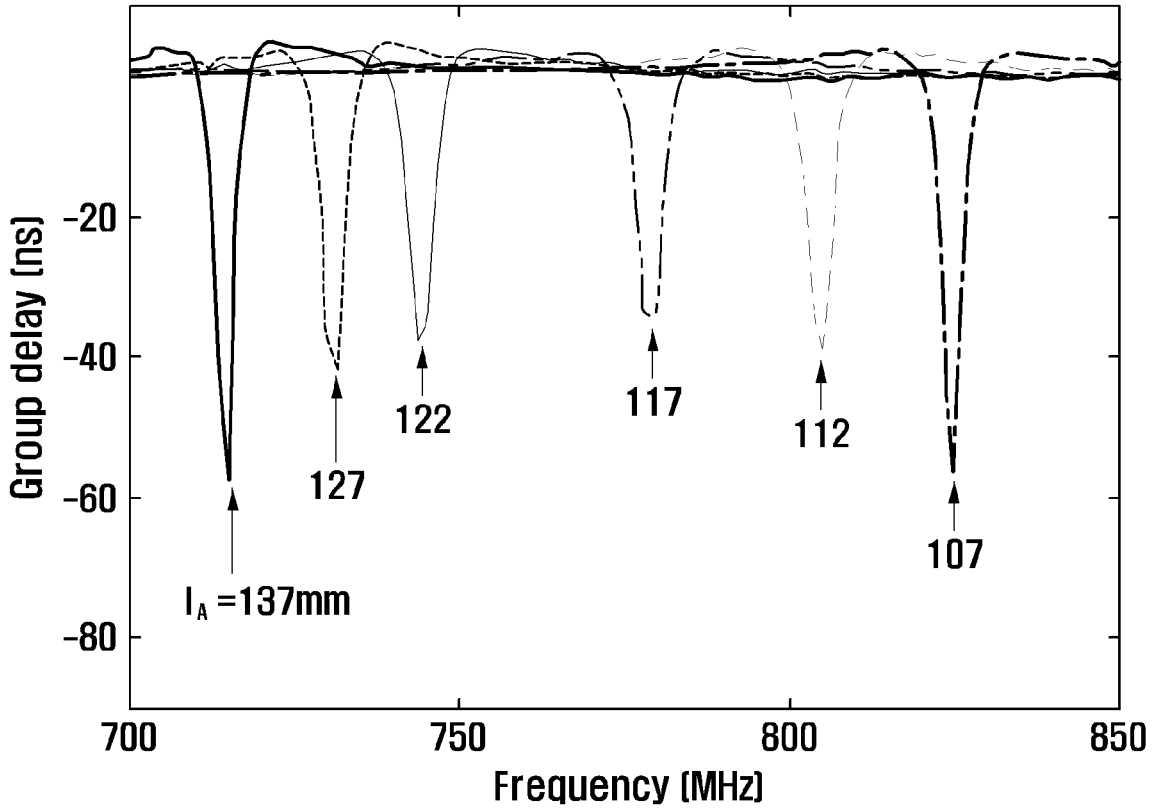
FIG. 12 is a graph illustrating variation of the group delay in the MIMO antenna apparatus, according to an embodiment of the present invention.
Figure 13:
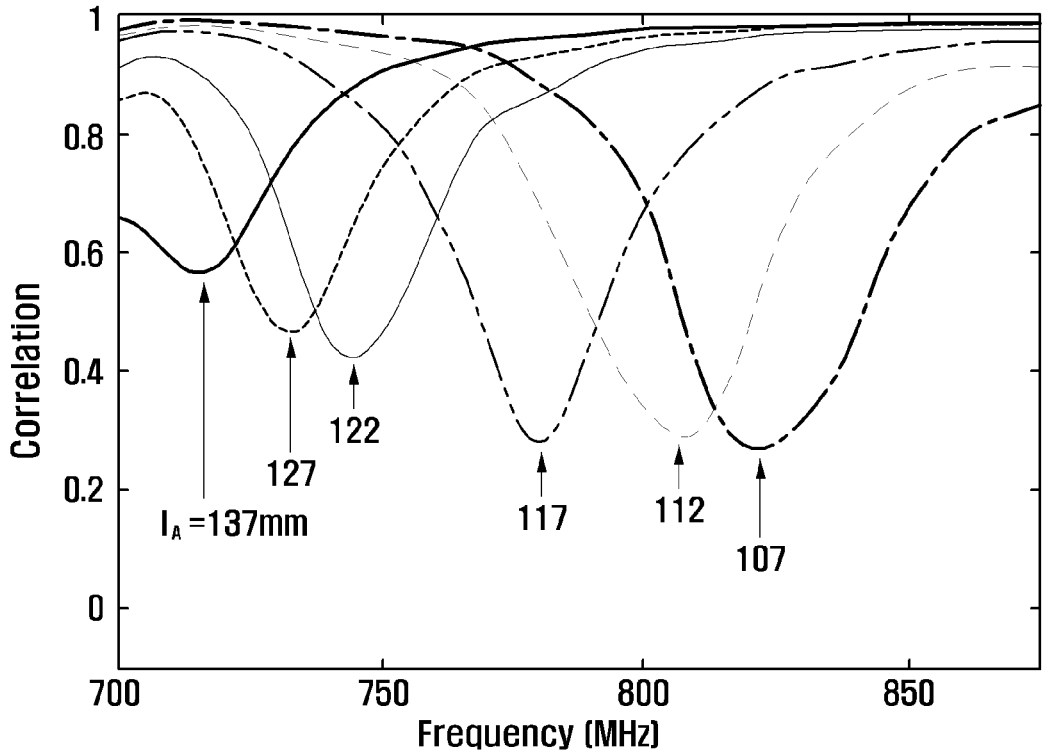
FIGS. 13A and 13B are graphs illustrating variation of the correlation between antenna devices in the MIMO antenna apparatus, according to an embodiment of the present invention.
Figure 13:
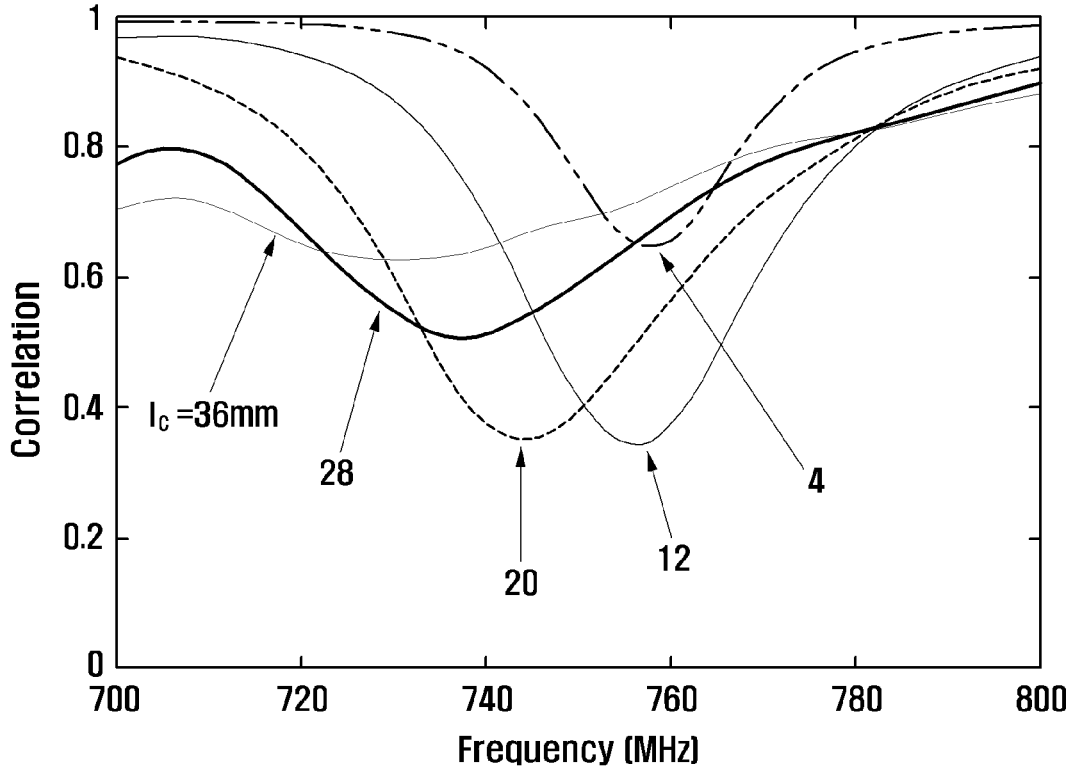

FIGS. 10 to 13B are graphs illustrating variations of operative characteristics by tuning the MIMO antenna apparatus, according to an embodiment of the present invention. FIG. 10 is a graph illustrating variation of the $S_{21}$ magnitude in the MIMO antenna apparatus, according to an embodiment of the present invention. FIG. 11 is a graph illustrating variation of the $S_{21}$ phase in the MIMO antenna apparatus, according to an embodiment of the present invention. FIG. 12 is a graph illustrating variation of the group delay in the MIMO antenna apparatus, according to an embodiment of the present invention. FIGS. 13A and 13B are graphs illustrating variation of the correlation between antenna devices in the MIMO antenna apparatus, according to an embodiment of the present invention. FIGS. 10 to 12 are depicted under the assumption that the total length of the positively charged line is fixed to 20 millimeters (mm) in the MIMO antenna apparatus. FIG. 13A is depicted under the assumption that the total length of the positively charged line is fixed to 20 mm, and FIG. 13B is depicted under the assumption that the total length of the antenna device is fixed to 124 mm in the MIMO antenna apparatus.

According to this embodiment of the present invention, the frequency band in which the S21 magnitude decreases abruptly moves to the low frequency band, as the total length of the antenna devices elongates as shown in FIG. 10. Also, the frequency band in which the gradient of the S21 phase varies abruptly decreases as the total length of the antenna devices elongates, as shown in FIG. 11. Further, the frequency band in which the group delay of voice is induced decreases as the total length of the antenna devices elongates, as shown in FIG. 12. The frequency band in which the correlation between the antenna devices decreases as the total length of the antenna devices elongates as shown in FIG. 13A. Accordingly, the correlation between the antenna devices of the MIMO antenna apparatus can be reduced efficiently by adjusting the total length of the antenna devices in the resonant frequency band of the MIMO antenna apparatus.

The frequency band in which the correlation between the antenna devices decreases can move in accordance with the variation of the total length of the positively charged line, as shown FIG. 13B. When the total length of the positively charged line is between 12 and 20 mm, the correlation between the antenna devices of the MIMO antenna apparatus is minimized. The resonant frequency band of each of the antenna devices is around 780 MHz with the wavelength ($\lambda_0$) of 385 mm. Specifically, when the total length of the positively charged line is between 0.03-fold and 0.05-fold of the wavelength of the resonant frequency band, the correlation reduction efficiency of the MIMO antenna apparatus is maximized. Thus, the correlation between antenna devices of the MIMO antenna apparatus can be reduced efficiently by adjusting the total length of the positively charged line in the resonant frequency band of the MIMO antenna apparatus.

Although embodiments of the present invention have been directed to the case where the antenna devices are formed in a meandering shape, the embodiments of the present invention are not limited thereto. Specifically, each antenna device can be formed in various shapes. For example, an embodiment of the present invention can be implemented with the antenna devices formed in one of meander, spiral, step, and loop shapes.

Figure 14:
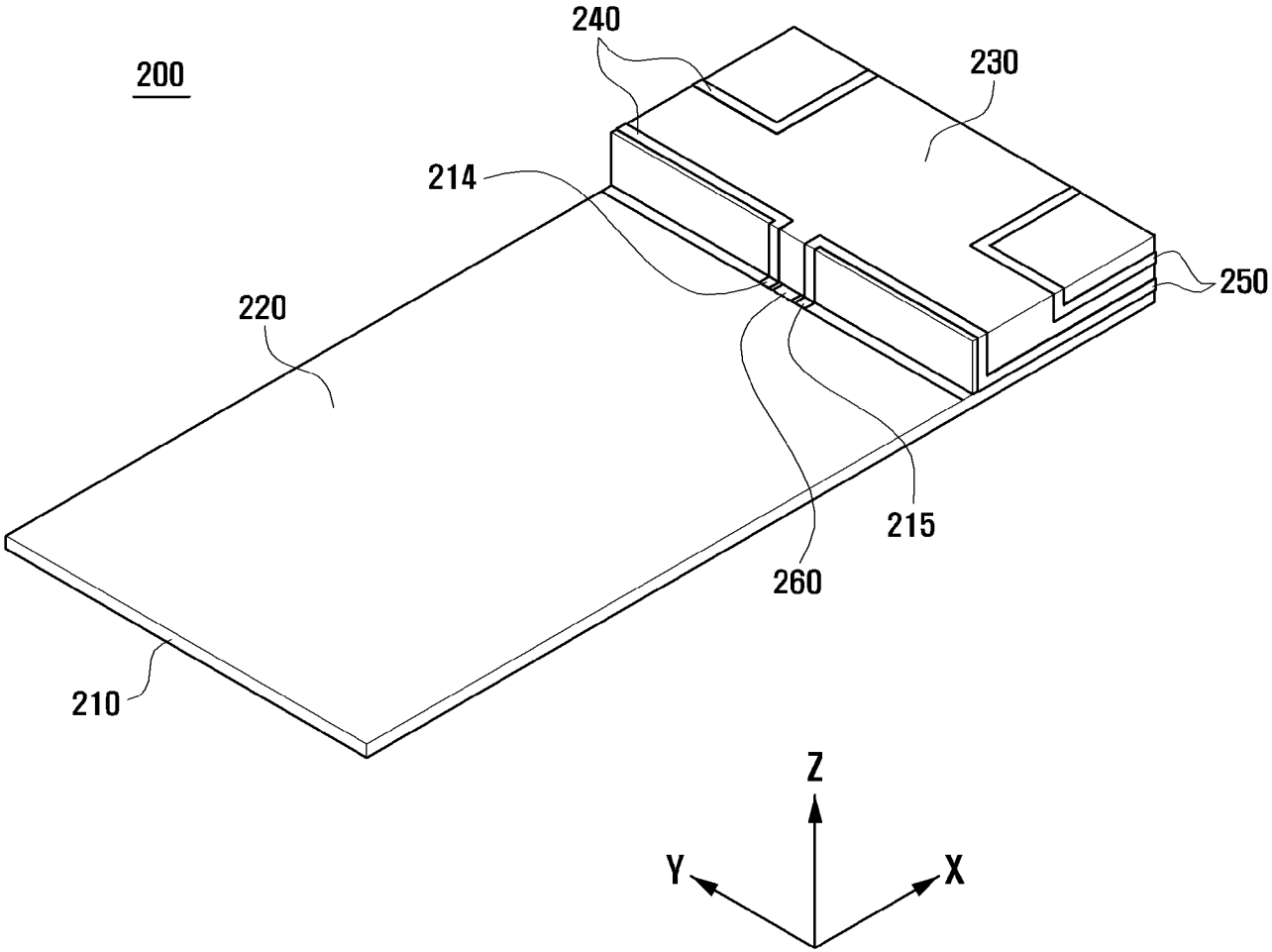
FIG. 14 is a diagram illustrating a perspective view of a MIMO antenna apparatus, according to an embodiment of the present invention.
Figure 15:
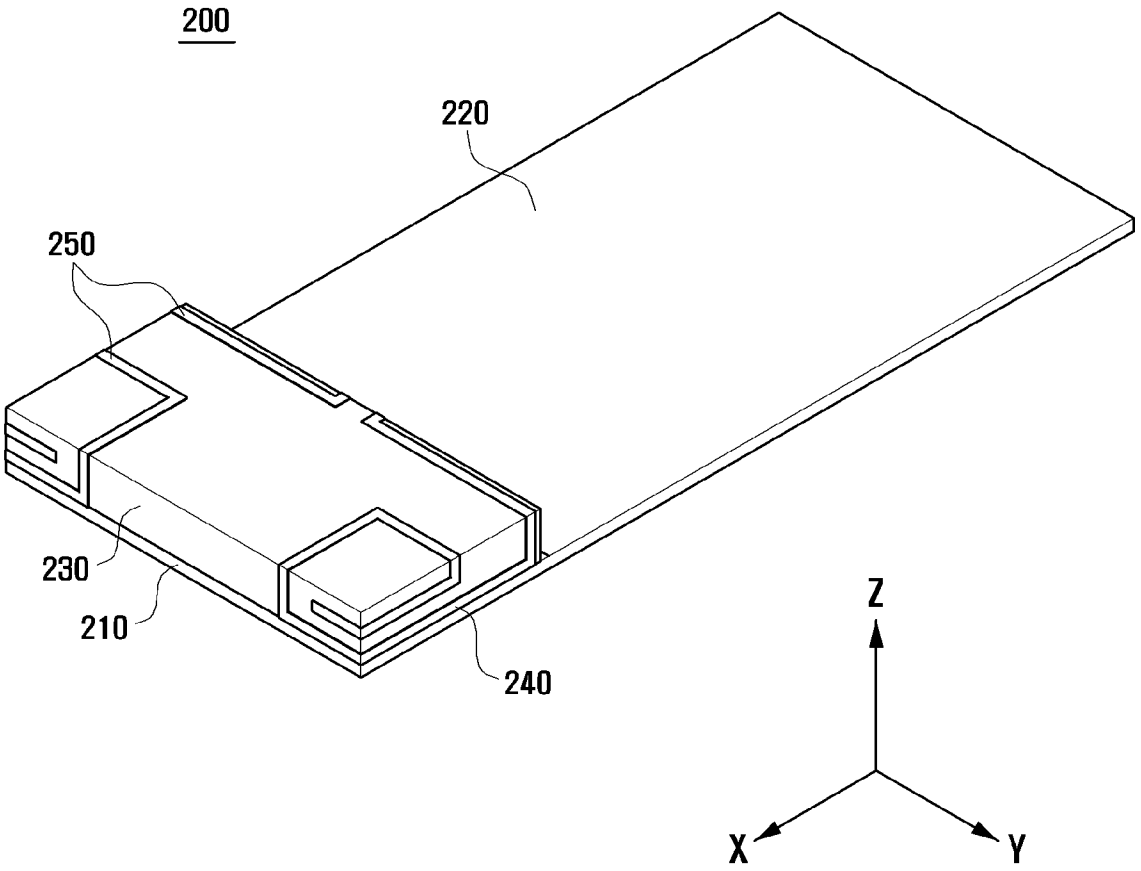
FIG. 15 is a diagram illustrating another perspective view of the MIMO antenna apparatus of FIG. 14, according to an embodiment of the present invention.
Figure 16:
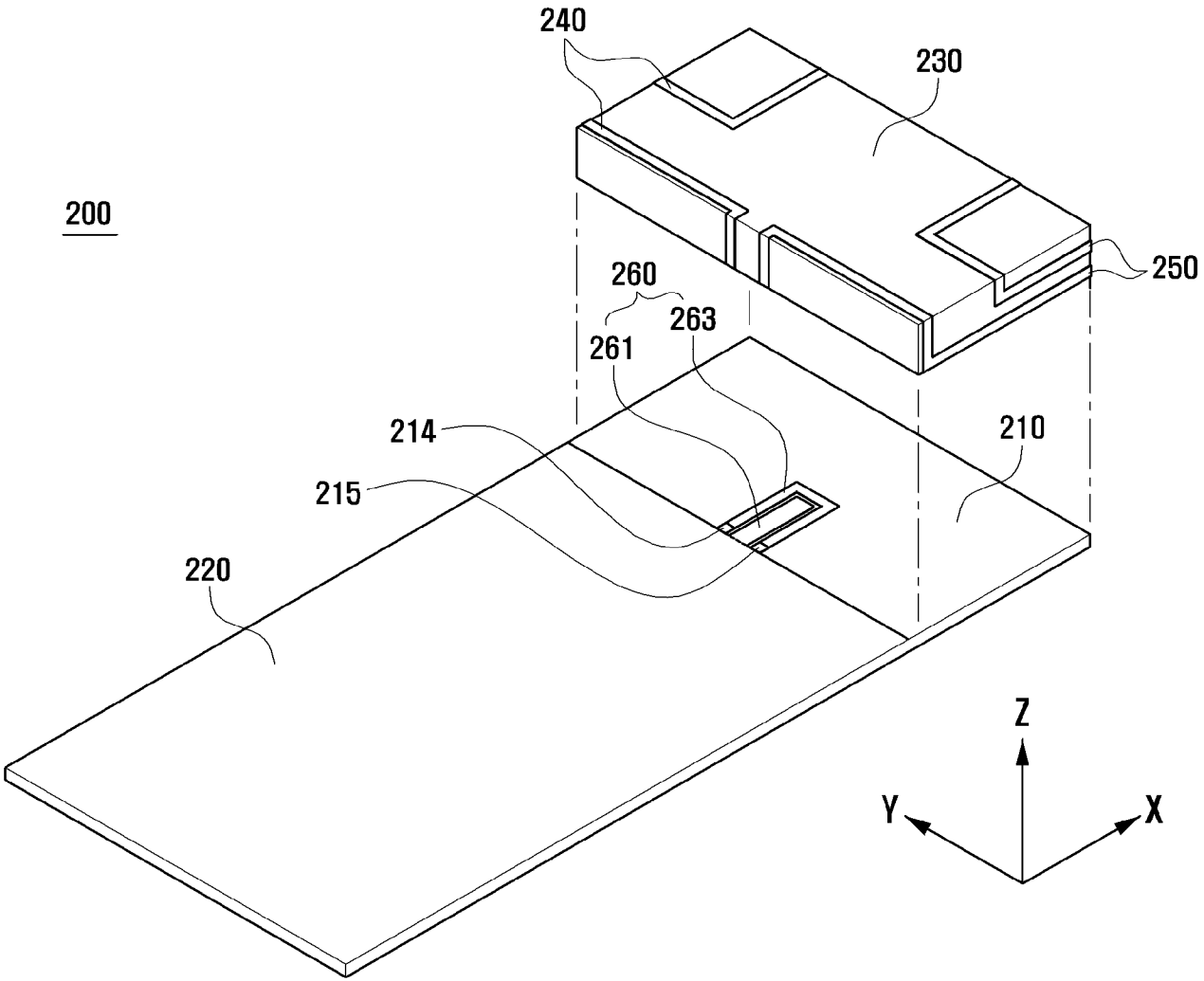
FIG. 16 is a diagram illustrating a dissembled perspective view of the MIMO antenna apparatus of FIG. 14, according to an embodiment of the present invention.

FIG. 14 is a diagram illustrating a perspective view of a MIMO antenna apparatus, according to an embodiment of the present invention. FIG. 15 is a diagram illustrating another perspective view of the MIMO antenna apparatus of FIG. 14, according to an embodiment of the present invention. FIG. 16 is a diagram illustrating a dissembled perspective view of the MIMO antenna apparatus of FIG. 14, according to an embodiment of the present invention. The following embodiment of the present invention is directed to a case where the MIMO antenna apparatus is implemented with a PCB.

Referring to FIGS. 14 to 16, the MIMO antenna apparatus includes a main board 210, a ground plate 220, an antenna carrier 230, antenna devices 240 and 250, and an isolation device 260. The basic configuration of the MIMO antenna apparatus 200 of FIGS. 14 to 16 is similar to that of the antenna apparatus 100 of FIGS. 1-3. The equivalent circuit of the MIMO antenna apparatus 200 of FIGS. 14 to 16 is also similar to that of the MIMO antenna apparatus 100 in FIG. 4.

The antenna devices 240 and 250 are formed in a spiral shape in FIGS. 14-16. Specifically, each of the antenna devices 240 and 250 is formed to have at least one curved portion. The antenna devices 240 and 250 are electrically connected to the antenna ports 214 and 215, respectively. The antenna devices 240 and 250 are extended along the surface of the antenna carrier 230. The antenna devices 240 and 250 can be connected to the ground plate 220 at their other ends. Also, the antenna devices 240 and 250 are formed so as to be symmetrical with each other.

In this embodiment of the present invention, the power is supplied through the antenna ports 214 and 215 from the external power source. The antenna devices 240 and 250 are resonant in the resonant frequency band. By selectively supplying the power to the antenna ports 214 and 215, at least one of the antenna devices 240 and 250 can be resonant in the resonant frequency band. During operation, the antenna devices 240 and 250 establish magnetic fields that cause electromagnetic coupling between the antenna devices 240 and 250. Specifically, the correlation between the antenna devices 240 and 250 may increase to a relatively high level.

The isolation device 260 is arranged between the antenna devices 240 and 250 on the main board 210. The isolation device 260 can be mounted on the surface of the main board 210. The isolation device 260 includes a negatively charged line 261 and a positively charged line 263.

The negatively charged line 261 extends from the ground plate 220 so as to protrude between the antenna devices 240 and 250. The negatively charged line 261 has the same characteristics as the ground plate 220. The negatively charged line 261 is formed in a bar type. The negatively charged line 261 can be arranged so as to be equally distant from the respective antenna devices 240 and 250.

The positively charged line 263 is connected to the antenna devices 240 and 250. The positively charged line 263 is electrically connected to the antenna ports 214 and 215. Specifically, the positively charged line 263 can extend from the antenna ports 214 and 215 regardless of the antenna devices 140 and 150. The positively charged line 263 extends in parallel with the negatively charged line 261 to maintain a predetermined distance. The positively charged line 263 is implemented as a power supply line made of a metallic material. The positively charged line 263 is shaped to have at least one curved portion. Here, the positively charged line 263 can be implemented as a looped shape.

In this embodiment of the present invention, when the antenna devices 240 and 550 operate, the electromagnetic wave is induced to the isolation device 260. Specifically, if the power is supplied from the external power source to the antenna ports 214 and 215, the positively charged line 263 operates as the positive electrode, and the negatively charged line 261 operates as the negative electrode. Along the space between the negatively charged line 261 and the positively charged line 263, the electromagnetic wave is induced.

While the MIMO antenna apparatus 200 is operating, the power is supplied to the antenna devices 240 and 250 and the isolation device 260 simultaneously. The antenna devices 240 and 250 and the positively charged line 163 share the ground plate 220 and the negatively charged line 261 for simultaneous grounding. The antenna devices 240 and 250 operate with a relatively high loss while the isolation device 260 operates with a relatively low loss, e.g., a loss rate of approximately 0. Thus, the MIMO antenna apparatus 200 operates with a large difference between loss rates of internal components and thereby, a relatively high dispersion. This leads to out-of-phase cancellation of the electromagnetic wave induced along the isolation device 260 and the electromagnetic wave coupled between the antenna devices 240 and 250. Such out-of-phase cancellation is represented by the negative group delay phenomenon in the S21 measurement of the MIMO antenna apparatus. As a consequence, the correlation between the antenna devices 240 and 250 of the MIMO antenna apparatus 200 is minimized. This means that the antenna devices 240 and 250 of the MIMO antenna apparatus 200 are isolated from each other.

Although the antenna devices of the MIMO antenna apparatus of this embodiment of the present invention are implemented in a spiral shape, it is possible to accomplish the operative characteristics similar to those of the MIMO antenna apparatus of the embodiment shown in FIGS. 1-3.

Figure 17:
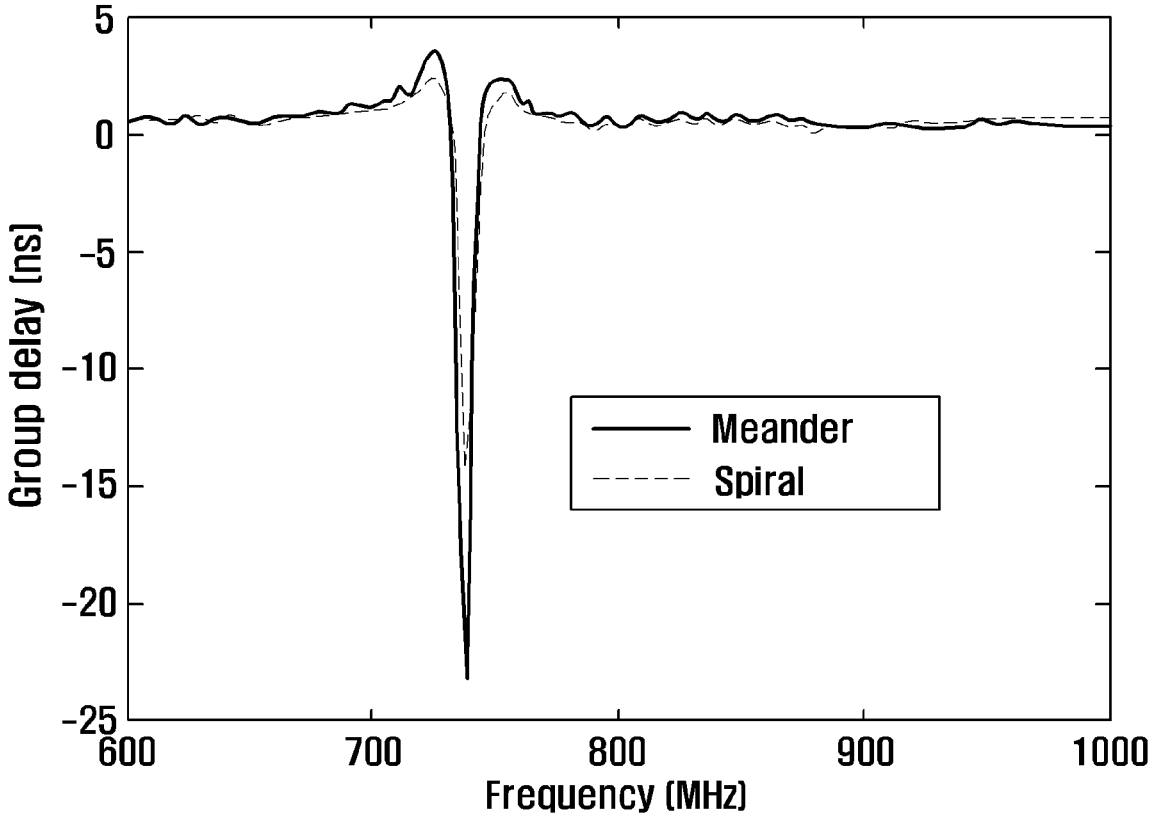
FIG. 17 is a graph illustrating variation of group delay in the MIMO antenna apparatuses, according to embodiments of the present invention.
Figure 18:
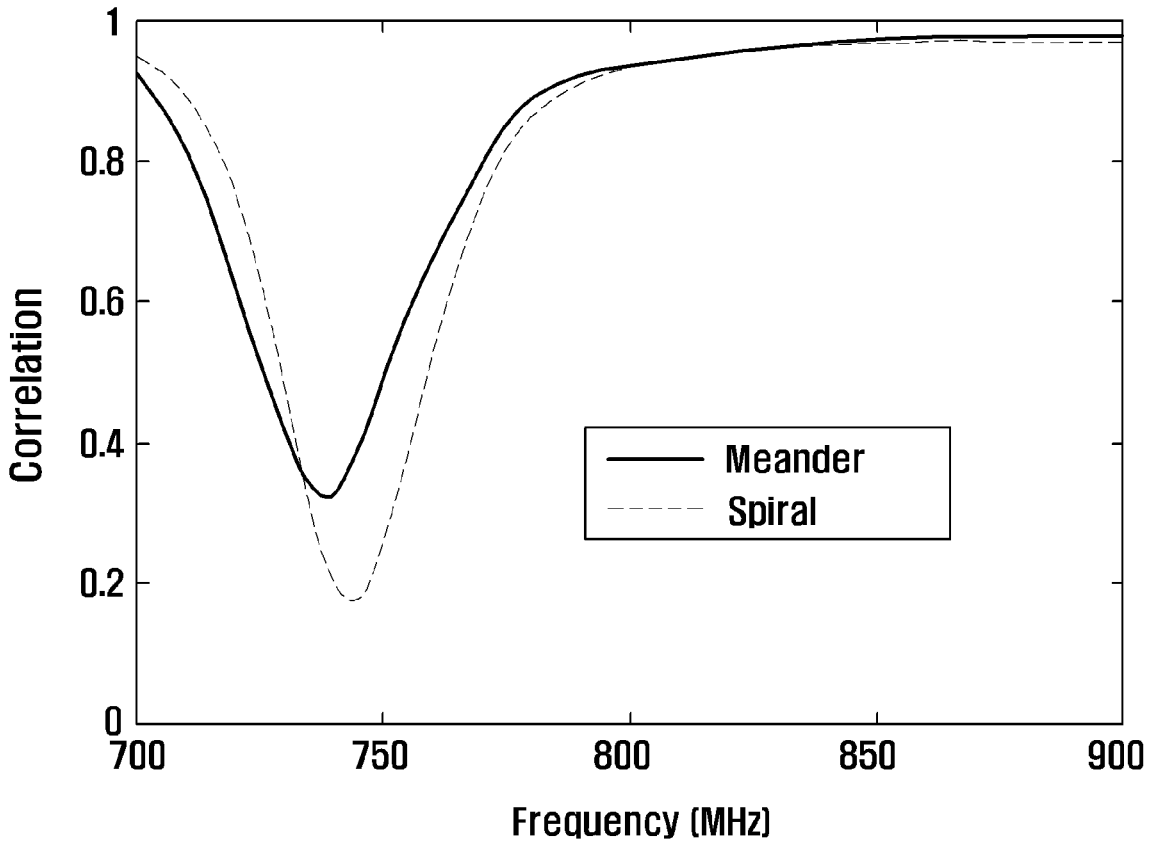
FIG. 18 is a graph illustrating variation of correlation between the antenna devices in the MIMO antenna apparatuses, according to embodiments of the present invention.

FIGS. 17 and 18 are graphs illustrating the differences between the operative characteristics of the MIMO antenna apparatus, according to the embodiments of the present invention. FIG. 17 is a graph illustrating variation of group delay in the MIMO antenna apparatuses, according to the embodiments of the present invention. FIG. 18 is a graph illustrating variation of correlation between the antenna devices in the MIMO antenna apparatuses, according to embodiments of the present invention. FIGS. 17 and 18 are directed to embodiments of the present invention in which the resonant frequency bands of the MIMO antenna apparatuses are fixed at 740 MHz.

The negative group delay is induced in the resonant frequency band in a similar manner in both embodiments of the present invention, as shown in FIG. 17. The correlation between the antenna devices in the resonant frequency band are decreased in a similar manner in both embodiments of the present invention, as shown in FIG. 18. Specifically, although the antenna devices of the MIMO antenna apparatus are formed differently in each embodiment, similar operative characteristics can be achieved.

Although the negatively charged line is formed in a bar type and the positively charged line in a loop type in the MIMO antenna apparatuses, the embodiments of the present invention are not limited thereto. Specifically, the object of the present can be accomplished even when the negatively charged line is formed in various structures having various types of grooves and holes, or when the negatively charged line is rounded. Further, the positively charged line can be formed to extend around the negatively charged line.

Although the MIMO antenna apparatuses are implemented so as to have two antenna devices arranged on the main board and an isolation device arranged between the antenna devices, the embodiments of the present invention are not limited thereto. Specifically, the embodiments of the present invention can be implemented with the arrangement of three or more antenna devices on the main board. Also, the MIMO antenna apparatus of the present invention can be implemented with two or more isolation devices arranged between the antenna devices. At least one isolation device can be interposed between two antenna devices. In such a configuration of the MIMO antenna apparatus, the antenna devices are resonant in at least one resonant frequency band, and the isolation devices block the at least one resonant frequency band.

Although the antenna devices are patterned on the antenna carrier in the MIMO antenna apparatuses of the previously described embodiments, the present invention is not limited thereto. Specifically, the MIMO antenna apparatus of the present invention can be implemented without patterning of at least one of the antenna devices and isolation device. For example, the antenna devices can be patterned directly on the main board. In this way, the MIMO antenna apparatus of the present invention can be implemented without the antenna carrier.

Although the antenna devices and isolation device are patterned on the main board or the antenna carrier in the MIMO antenna apparatuses of the previously described embodiments, the present invention is no limited thereto. Specifically, the MIMO antenna apparatus of the present invention can be implemented with a device combination having at least one of the antenna devices and isolation device having unique inductance and capacitance. For example, the antenna devices can be implemented as a device combination while the isolation device is implemented as power supply line.

In the MIMO antenna apparatuses, the antenna devices can be implemented in the form of a power supply circuit having a metamaterial structure. The metamaterial is a material or an electrical structure synthesized in an artificial way to acquire special electromagnetic characteristics rare in the natural world. The metamaterial has negative values of both the permittivity and permeability under a special condition and shows the electric wave propagation characteristics different from those of the normal material and electrical structure. In the embodiments of the present invention, the metamaterial is structured to use the characteristic inversing the phase speed of the electromagnetic wave, i.e., Composite Right/Left Handed (CRLH) structure. The CRLH structure is implemented in a structure combining a Right Handed (RH) structure showing normal characteristics in which the directions of the electrical field, magnetic field, and electromagnetic wave abide by the right handed rule, and a Left Handed (LH) structure showing characteristics in which the directions of the electrical field, magnetic field, and electromagnetic wave abide by the left handed rule in opposition to the right handed rule.

While the MIMO antenna apparatus is operating, the isolation device of the MIMO antenna apparatus of the present invention induces the negative group delay phenomenon in the resonant frequency band. As a consequence, the isolation device of the MIMO antenna apparatus can minimize the correlation between antenna devices. Specifically, the isolation device of the MIMO antenna apparatus can suppress the electromagnetic coupling between the antenna devices, thereby improving radiation characteristics of the antenna devices of the MIMO device and the throughput of the wireless communication system.

While the present invention has been shown and described with reference to certain embodiments thereof, it will be understood by those skilled in the art that various changes in form and detail may be made therein without departing from the spirit and scope of the invention as defined by the appended claims.

What is claimed is:

1. A Multiple-Input Multiple-Output (MIMO) antenna apparatus comprising:

a plurality of antenna devices that operate in respective resonant frequency bands when power is supplied;

a main board comprising a device region and a ground region, wherein the plurality of antenna devices are disposed on the device region, and wherein the a ground plate is disposed on the ground region for grounding the plurality of antenna devices; and at least one isolation device comprising a negatively charged line that protrudes from the ground plate and extends between the plurality of antenna devices on the device region, and a positively charged line that extends around the negatively charged line and connects the plurality of antenna devices to each other, wherein the isolation device induces an electromagnetic wave that is generated by the plurality of antenna devices between the negatively and positively charged lines to isolate the plurality of antenna devices from each other.

2. The MIMO antenna apparatus of claim 1, wherein the positively charged line extends from the antenna ports to connect the plurality of antenna devices in the device region.

3. The MIMO antenna apparatus of claim 2, wherein the negatively charged line is formed in a bar shape and the positively charged line is formed in a loop shape.

4. The MIMO antenna apparatus of claim 2, wherein the positively charged line is a power supply line having a plurality of curved portions which is identical to the negatively charged line in shape, which comprises at least one of meandering, spiral, step, and loop.

5. The MIMO antenna apparatus of claim 1, further comprising an antenna carrier that is mounted on the device region and on which the plurality of antenna devices are formed.

6. The MIMO antenna apparatus of claim 5, wherein the isolation device is disposed a predetermined distance away from the antenna devices by means of the antenna carrier.

7. The MIMO antenna apparatus of claim 5, wherein the plurality of antenna devices and the isolation device are patterned on at least one of the main board and the antenna carrier.

8. The MIMO antenna apparatus of claim 1, wherein the plurality of antenna devices are power supply lines having a plurality of curved portions and having a shape comprising at least one of meandering, spiral, step, and loop.

9. The MIMO antenna apparatus of claim 1, wherein the device region has antenna ports that are electrically connected to supply power to the plurality of antenna devices.

10. The MIMO antenna apparatus of claim 1, wherein the plurality of antenna devices are arranged in the device region of the main board such that they are maintained a predetermined distance from each other.

11. The MIMO antenna apparatus of claim 10, wherein the positively charged line extends the predetermined distance around the negatively charged line.

12. An isolation device of a Multiple-Input Multiple-Output (MIMO) antenna comprising:

a negatively charged line that protrudes from a ground plate and extends between a plurality of antenna devices; and a positively charged line that extends around the negatively charged line and connects the plurality of antenna devices to each other;

wherein the isolation device induces an electromagnetic wave that is generated by the plurality of antenna devices between the negatively and positively charged lines to isolate the plurality of antenna devices from each other.

13. The isolation device of claim 12, wherein the negatively charged line is formed in a bar shape and the positively charged line is formed in a loop shape.

14. The isolation device of claim 12, wherein the positively charged line is a power supply line having a plurality of curved portions which is identical to the negatively charged line in shape, which comprises at least one of meandering, spiral, step, and loop.

* * * * *